US007347540B2

(12) United States Patent
Piock et al.

(10) Patent No.: US 7,347,540 B2
(45) Date of Patent: Mar. 25, 2008

(54) INKJET PRINTING DEVICE

(75) Inventors: Richard Piock, Bruneck (IT); Franz Obertegger, Brixen (IT)

(73) Assignee: Durst Phototechnik-A.G., Brixen (IT)

( * ) Notice: Subject to any disclaimer, the term of this patent is extended or adjusted under 35 U.S.C. 154(b) by 54 days.

(21) Appl. No.: 10/515,723

(22) PCT Filed: May 16, 2003

(86) PCT No.: PCT/EP03/05150

§ 371 (c)(1),
(2), (4) Date: Nov. 24, 2004

(87) PCT Pub. No.: WO03/099570

PCT Pub. Date: Dec. 4, 2003

(65) Prior Publication Data

US 2006/0038861 A1 Feb. 23, 2006

(30) Foreign Application Priority Data

May 29, 2002 (AT) ..... A 828/2002
May 29, 2002 (IT) ..... BZ02A0025

(51) Int. Cl.
*B41J 2/175* (2006.01)
*B41J 2/015* (2006.01)

(52) U.S. Cl. ..... 347/85; 347/21; 347/87

(58) Field of Classification Search ..... 345/5, 345/7, 20, 21, 84, 85, 89, 93
See application file for complete search history.

(56) References Cited

U.S. PATENT DOCUMENTS 3,930,258 A 12/1975 Dick et al.
4,126,868 A 11/1978 Kirner
4,432,005 A * 2/1984 Duffield et al. ..... 347/86
4,908,638 A 3/1990 Albosta et al.
4,910,529 A * 3/1990 Regnault ..... 347/6
4,987,429 A * 1/1991 Finley et al. ..... 347/115
5,220,345 A * 6/1993 Hirosawa ..... 347/17
5,409,138 A * 4/1995 Nakano ..... 222/64
5,659,347 A * 8/1997 Taylor ..... 347/85
6,007,193 A * 12/1999 Kashimura et al. ..... 347/92
6,024,441 A 2/2000 Nishimoto
6,084,617 A 7/2000 Balazer
6,168,268 B1 * 1/2001 Sugiyama ..... 347/89
6,478,415 B2 * 11/2002 Barinaga et al. ..... 347/85
6,588,339 B2 * 7/2003 Naniwa et al. ..... 101/465
6,817,705 B1 * 11/2004 Crockett et al. ..... 347/85

FOREIGN PATENT DOCUMENTS

DE 24 49 732 1/1976
DE 25 43 452 3/1977
DE 28 42 594 4/1980

(Continued)

*Primary Examiner*—Anh T. N. Vo
(74) *Attorney, Agent, or Firm*—Collard & Roe, P.C.

(57) ABSTRACT

The invention relates to an inkjet printing apparatus (1) with at least one printing head (2). Several tanks (3, 4) for inks and/or a cleaning medium are arranged in front of a connection opening (7) for the printing head (2), and the tanks (3, 4) are connected by feed lines (5) with the connection opening (7) for the printing head (2), whereby a stop element (6) is arranged between each tank (3, 4) and the connection opening (7).

46 Claims, 3 Drawing Sheets

FOREIGN PATENT DOCUMENTS

| | | |
|---|---|---|
| EP | 0 640 479 | 3/1995 |
| FR | 2 618 727 | 3/1989 |
| FR | 2 608 225 | 6/1998 |
| JP | 56 080473 | 7/1981 |
| JP | 57070667 | 5/1982 |
| JP | 2000203051 | 7/2000 |

* cited by examiner

INKJET PRINTING DEVICE

CROSS REFERENCE TO RELATED APPLICATIONS

Applicants claim priority under 35 U.S.C. §119 of Austrian Application No. A828/2002 filed on May 29, 2002 and Italian Application BZ2002A000025 filed on May 29, 2002. Applicants also claim priority under 35 U.S.C. §365 of PCT/EP03/05150 filed on May 16, 2003. The international application under PCT article 21(2) was not published in English.

The invention relates to an inkjet printing apparatus and a printing head for inkjet printing apparatus, as described in the preamble of claims 1 and 31.

BACKGROUND OF THE INVENTION

1. Field of the Invention

Inkjet printing apparatus or inkjet printers are already known, in which an ink tank or ink reservoir is placed in front of a nozzle or a group of nozzles of a printing head for applying or discharging inks. The ink reservoir is connected via channels to the nozzle or group of nozzles on the one hand and via a feed line to the ink tank on the other hand. The disadvantage of this was that due to this method of supplying ink printing devices could only be produced that could handle one type of ink. In order to work with different types of ink the machine needed to be completely reset.

2. The Prior Art

The demand for inkjet printers that use various different ink systems, i.e. inks of different kinds, is particularly high in large scale production, where the same printing apparatus needs to be used for printing different materials, such as paper, cardboard, plastic film or even textiles. Solutions to this problem have already been proposed which enable an inkjet printer to be reset to use different ink systems.

In U.S. Pat. No. 6,024,441 A an inkjet printing apparatus is described, comprising ink storing tanks, flexible feed lines and connecting units for the printing heads. For different colours from different ink systems feed lines run from the ink tanks to a connecting unit belonging to an ink system The printing heads of the inkjet printing apparatus are in turn connected to printing head connecting portions on the printing head connecting units, whereby the supply of ink to the printing heads is ensured. In order to reset the inkjet printing apparatus to a new ink system it is necessary to remove the printing heads from the inkjet printing apparatus by releasing the printing head connecting portions from the printing head connecting units. The printing heads are then exchanged and the new set of printing heads are connected to the printing head connecting units of the new ink system. The exchange of the ink system in inkjet printing apparatus as described in U.S. Pat. No. 6,024,441 A thus requires a considerable amount of manipulation to remove or install the printing heads.

The objective of the present invention is to create an inkjet printing apparatus which can be used universally without the need for long resetting times at the inkjet printer.

SUMMARY OF THE INVENTION

The objective of the invention is achieved by claim 1. It is advantageous in this embodiment that with one set of printing heads different ink systems or inks with different properties, viscosity, colour, colour concentration etc. can be used. In order to reset the printer the different tanks only need to be connected with the printing heads by adjusting the stop elements appropriately, it is not necessary to changed the printing heads or completely convert the inkjet printing apparatus or inkjet printer, and the advantages of each type of ink can still be utilised with one single inkjet printing apparatus.

The development of the inkjet printing apparatus according to claim 2 has the advantage that an intermediate or buffer store for storing ink is provided by the reservoirs, and this provides a safeguard against an interruption of operation due to empty tanks.

The development of the inkjet printing apparatus according to claim 3 has the advantage that the required amount of ink can flow into the printing head and thus any reduction in print quality can be avoided.

By means of the development of the inkjet printing apparatus according to claim 4, in which a reservoir is arranged in the printing head, inkjet printing apparatus can be produced in an advantageous manner with a much more compact structure.

A development of the inkjet printing apparatus according to claim 5 is also advantageous, as thereby fewer components need to be used. By using a common multiway valve as a stop element the risk of malfunction is also reduced, as it is not possible for ink or cleaning medium to flow into the printing head simultaneously from several tanks.

The development of the inkjet printing apparatus according to claim 6 has the advantage that the feeding of ink or cleaning medium into the printing head is independent of the effect of gravity and thus the tanks can be arranged in any area of the inkjet printer. The conveyance of the ink or cleaning medium is ensured in each case by the pumps.

By means of the design of the inkjet printing apparatus according to claim 7 in an advantageous manner impurities are prevented from entering into the printing head and the nozzles cannot become blocked.

The development according to claims 8 and 9 is also advantageous as thereby the pressure balancing of ink in the printing head or in the corresponding reservoir can be achieved by the pressure in the corresponding tank.

By means of the developments of the inkjet printing apparatus according to claims 10 to 14, the inks can always be kept within an optimum operating temperature range for processing, and the supply of the printing head with ink can be automated and in particular controlled by program.

The design of the inkjet printing apparatus according to claim 15 has the advantage that thereby inkjet printing apparatus can be manufactured to have a very broad range of applications. Inkjet printers with inkjet printing apparatus of this kind can be used in inkjet printers of varying designs and in very different areas of application.

The development according to claim 16 is also advantageous as the cleaning of the printing heads made possible thereby shortens the time needed for resetting inkjet printing apparatus to a new ink system considerably, and misprints caused by the temporary and undesired mixing of inks of different types can be avoided.

The development of the inkjet printing apparatus with a filling height sensor according to claims 17 and 18 has the advantage that the filling height of inks in the reservoirs can always be determined. It can also be ensured that there is always a sufficient amount of ink in the reservoirs and the supply of ink in the reservoirs can be prevented from running out, thus preventing the interruption of printing and as a result the production of misprints.

By means of the design of the inkjet printing apparatus according to claims 19 to 22, in which the reservoirs or the distribution chamber are provided with ventilation openings or a pressure control valve, in particular a servo valve, it is ensured in an advantageous manner that the ink can flow unimpeded from the reservoirs into the area of the spray devices. In this way pressure variations in the distribution chamber of the printing head are avoided and ink drops of varying sizes cannot be expelled from the printing head, which influences the quality of the print.

The development of the inkjet printing apparatus according to claim 23 has the advantage that dust particles from the environment cannot enter the printing head and cause the nozzles of the printing head to become blocked as a result.

The development of the inkjet printing apparatus according to claims 24 and 25 is also advantageous, as thereby pressure fluctuations disrupting the flow of ink in the feed lines or the reservoirs can be reduced. Variations in pressure are caused mainly by the acceleration forces acting on the ink which occur during the movement of the printing head in transverse direction over the printing medium.

The design of the inkjet printing apparatus according to claim 26 is advantageous in that if an ink is not actually in use the latter is conveyed in a circuit and thus the components or ingredients of the ink cannot be deposited in the lines.

The design of the inkjet printing apparatus according to claim 27 is advantageous in that the arrangement of the ink tanks can be made more compact, in particular a smaller number of tanks for the various colours of inks of the different ink systems can be found to be sufficient.

A development of the inkjet printing apparatus according to claims 28 and 29 is also advantageous as thereby the control of the various operating states of the inkjet printing apparatus can be automated or program controlled.

The development of the inkjet printing apparatus according to claim 30 has the advantage that the supply of the inkjet printing apparatus with ink or the required cleaning medium can be ensured over longer periods and thus the operation of the inkjet printing apparatus can be ensured without interruption.

The objective of the invention is achieved independently by means of a printing head according to the features in the characterising part of claim 31. It is an advantage here that one set of printing heads can be used for the required number of colours and inks of different ink systems. In order to adjust between the various ink systems it is merely necessary to close or open the stop elements of the printing head accordingly. A further advantage is that when adjusting to a new ink system the ink residue remaining in the reservoirs does not have to be removed and thus material losses can be reduced.

By means of the printing head according to claims 32 to 34 in which the reservoirs are designed to have ventilation openings it is ensured in an advantageous manner that the ink can flow from the reservoirs in the correct amount for uninterrupted operation in the region of the spray devices.

It is ensured by the development of the printing head according to claim 35 that no dust particles or impurities from the air enter the nozzles of the printing head and cause a blockage of the latter.

The development of the printing head according to claim 36 is also advantageous as it is possible thereby to keep the inks within the optimum range of temperatures for processing.

The development of the printing head according to claim 37 makes it possible in an advantageous manner to use such printing heads for working various ink systems and to use them in inkjet printers of very different kinds.

By means of the printing head according to claim 38 it is possible to reduce the time required to reset for processing ink from a new ink system and thus avoid the losses of inks through undesired mixing of the inks from different ink systems.

BRIEF DESCRIPTION OF THE DRAWINGS

For a better understanding of the invention the latter is explained in more detail with reference to the following drawings.

In a schematically simplified view.

DETAILED DESCRIPTION OF PREFERRED EMBODIMENTS

First of all, it should be noted that in the variously described embodiments the same parts are allocated the same reference numbers and the same component names, whereby the disclosures contained throughout the description can be applied accordingly to the same parts with the same reference numbers or same component names. The details used in the description on position such as top, bottom, side etc. refer to the Figure being described at the time, and where there is a change of position should be adjusted to the new position accordingly. Furthermore, individual features or combinations of features from the shown and described embodiments can in themselves represent independent, inventive solutions.

Figure 1:
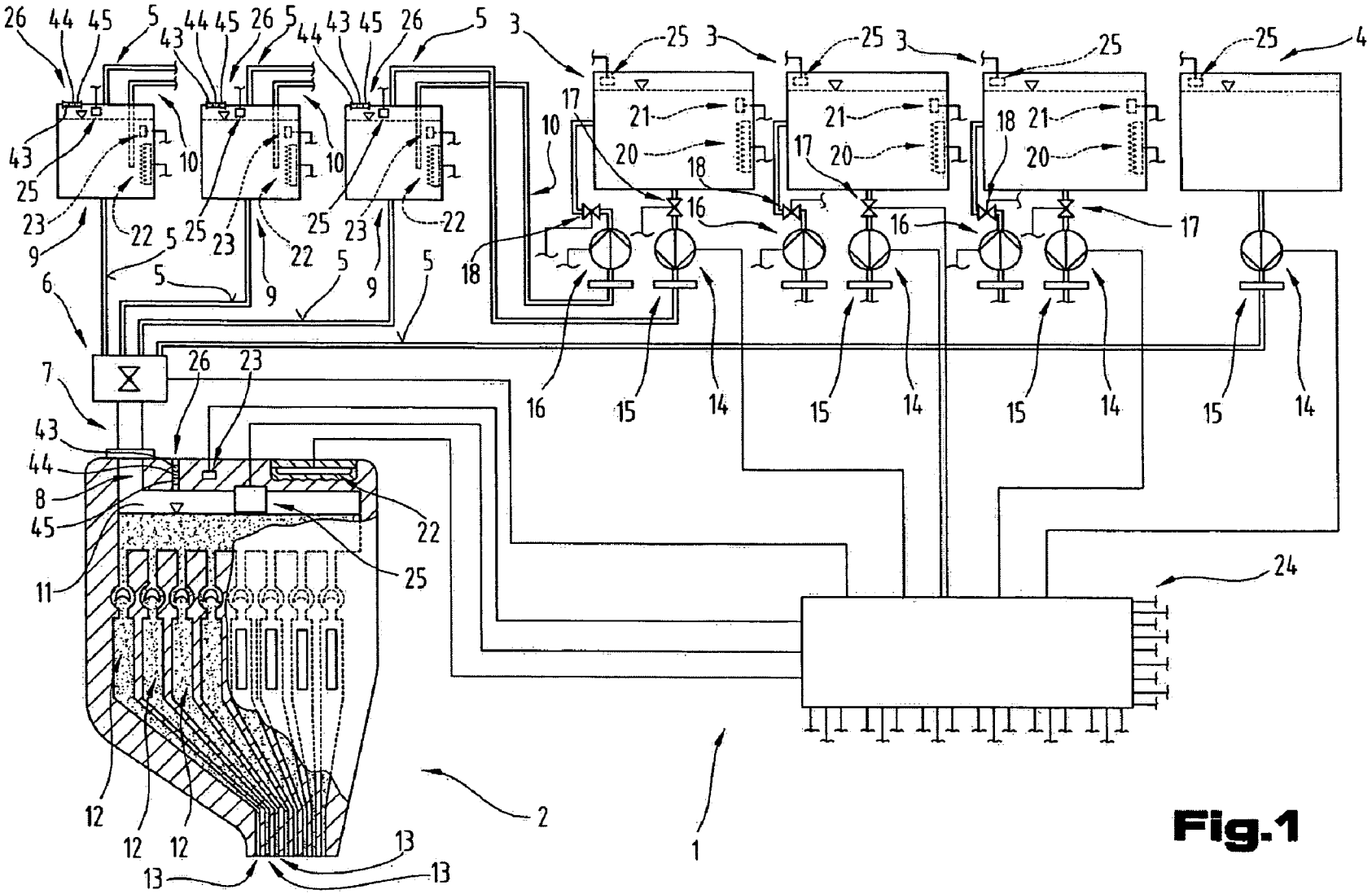
FIG. 1 shows an inkjet printing apparatus with a printing head.

FIG. 1 shows an inkjet printing apparatus 1 with a printing head 2.

The inkjet printing apparatus 1 comprises three tanks 3 for holding various inks and a tank 4 for holding a cleaning medium, whereby the tanks 3, 4 are connected by feed lines 5 to a stop element 6 and a connection opening 7. The connection opening 7 of the stop element 6 is connected with a feed opening 8 of the printing head 2. The stop element 6 of the inkjet printing apparatus 1 is in the present embodiment in the form of a multiway valve. Of course, it is also possible for each feed line 5 to have a separate valve and for the outlet openings of said valves to open into a common connection opening 7.

Thus several tanks 3, 4 for inks and/or a cleaning medium are arranged in front of the connection opening 7 for the printing head 2, whereby the tanks 3, 4 are connected by feed lines 5 to the connection opening 7 and a stop element 6 is arranged between each tank 3, 4 and the connection opening 7.

There is a reservoir 9 between the ink tanks 3 and the stop element 6 in the path of the feed line 5. Said reservoirs 9 are arranged together with the stop element 6 close to the printing head 2, whereby the reservoirs 9 are designed as pressure compensating containers. Between each reservoir 9 and tank 3 for the ink there is also a return line 10. This makes it possible to convey ink from the reservoir 9 back into the tank 3 and has the advantage that if an ink is not in use and the stop element 6 for this ink is closed the ink can be conveyed between the reservoir 9 and the tank 3 in a circuit, and thus the deposit of elements or ingredients of the ink in the lines (feed line 5, return line 10) is avoided.

The printing head 2 is designed in a known manner and comprises a distribution chamber 11 which is fed with ink via the feed opening 8 at a first end and at a second end releases ink to, in this case eight, spray devices 12. By activating the spray devices 12 the ink is ejected through nozzles 13 arranged in a lower end region of the printing head 2 and thus applied onto the medium to be printed.

In order to convey the inks or a cleaning medium from the tanks 3 or 4 to the printing head a pump 14 is arranged in each of the feed lines 5. In order to prevent the penetration of impurities into the printing head 2 a filter 15 is also arranged in the feed lines 5. Analogously a pump 16 is arranged in each of the return lines 10.

A stop element 17 is arranged in each of the feed lines 5 between each of the tanks 3 and the connected reservoir 9. A stop element 18 is arranged correspondingly in the return lines 10 between each of the tanks 3 and the reservoir 9 connected thereto. By means of these stop elements 17, 18 the reservoirs 9 can be separated from the respective tanks 3 with regard to the pressure, so that a stable flow of ink to the printing head 2 can be achieved.

As in order to use inks from some ink systems it may be necessary to increase their temperature above room temperature, the tanks 3 are equipped with heating elements 20 and thermometers 21 respectively. For the same reason the printing head 2 or the reservoirs 9 are also equipped with a heating element 22 and a thermometer 23. Of course it is also possible for the tanks 3 or the reservoirs 9 to be provided with a common heating element 20 or a common heating element 22. Accordingly it is sufficient in most cases if the tanks 3 or the reservoirs 9 only have a common thermometer 21 or a common thermometer 23.

For the automated control of the entire inkjet printing apparatus 1 the latter is equipped with a control device 24. The stop element 6 in the form of a multiway valve is driven by the control device 24 in such a way that only one of the feed lines 5 is ever connected continuously with the connection opening 7, and thus the feed opening 8 of the printing head 2. From the tank 3 of which the feed line 5 is located in the opened state relative to the connection opening 7, by means of the pump 14 ink is conveyed from the tank 3 via the corresponding reservoir 9 into the distribution chamber 11 of the printing head 2. The corresponding pump 14 is also controlled by the control device 24. The conveyance of the ink from the reservoir 9 to the distribution chamber 11 can thus be performed by the effect of gravity on the ink as well as by a separate pump (not shown) arranged between the reservoir 9 and the stop element 6.

In order to measure the filling height of the ink in the corresponding containers the tanks 3, the reservoirs 9 and the distribution chambers 11 of the printing head 2 are equipped in their inner chamber with a filling height sensor 25. By means of said filling height sensors 25 the filling height can be measured continuously by the control device 24 connected therewith. In a preferred embodiment said filling height sensors 25 are arranged respectively at an upper end of the tanks 3, 4, the reservoirs 9 or the distribution chamber 11. In order to equalize the pressure with environmental pressure the reservoirs 9 and the distribution chamber 11 of the printing head 2 are provided respectively with a ventilation opening 26. The ventilation opening 26 in turn has an air filter 45 which prevents particles of dust entering the nozzles 13 of the printing head 2 and blocking the latter.

Alternatively, it is also possible for the printing head 2 not to have its own ventilation opening 26 or filling height sensor 25. In this variant of the invention the distribution chamber 11 of the printing head 2 is filled completely with ink and the pressure equalization with the environmental air pressure can be achieved by means of the ventilation opening 26 of the corresponding reservoir 9 or low pressure can be applied in order to prevent the ink running out. A pressure control circuit 44 is preferably connected to the ventilation opening 26 by means of which the pressure in the distribution chamber 11 or the corresponding reservoir 9 can be set so that ink is prevented from running out of the nozzles 13 of the printing head 2.

The operation of the pump 14 and the stop element 6 by the control device 24 is always performed in such a way that the filling height of the distribution chamber 11 and the reservoir 9 with ink remains within a prespecified range.

The control device 24 is thus designed in such a way that the distribution chamber 11 of the printing head 2 or the reservoir 9 can be filled with ink thereby, whereby the filling can be semiautomatic as well as fully automatic. By means of the filling height sensors 25 in the tanks 3, 4 the control device 24 can also be used to refill the tanks 3, 4 with the corresponding inks or a cleaning medium from refill containers connected thereto and set up separately from the inkjet printing apparatus. In this manner the inkjet printing apparatus can be operated without interruption.

The corresponding tank 3 and the reservoirs 9 and the printing head 2 are held by heating element 20 or heating element 22 at the operating temperature required for the corresponding ink, whereby the actual temperature is determined by the thermometer 21 or 23 in cooperation with the control device 24 and thus the maintenance of the operating temperature can be monitored.

If the inkjet printing apparatus or the inkjet printer needs to be reset to print a different medium it is necessary in most cases for the inkjet printing apparatus to be converted to work with ink from a different ink system, i.e. inks of a different kind. By means of the inkjet printing apparatus 1 according to FIG. 1 this is made possible in an advantageous manner in that the printing head 2, i.e. its distribution chamber 11 and its spray devices 12 with nozzles 13, are firstly cleaned with a cleaning medium. For this the stop element 6 in the form of a multiway valve is adjusted by the control device 24 so that the feed line 5 of the tank 4 or the connection opening 7 is moved into the open position. By controlling the pump 14 of the tank 4 cleaning medium is then pumped into the printing head 2. By operating the spray devices 12 simultaneously the residue of the remaining ink is removed from the printing head 2 and the distribution chamber 11, the spray devices 12 and the nozzles 13 are cleaned.

In addition to this cleaning process by feeding through the cleaning medium it is also possible for compressed air to be blown into the printing head 2 through a separate feed line (not shown), and thus any residue of cleaning medium residing in the printing head 2 is removed from the printing head 2. It is of course necessary for the ventilation opening 26 of the printing head 2 to be closed by a corresponding valve 43. It is particularly advantageous to design the ventilation openings 26 of the printing head 2 and the reservoir 9 as a pressure control valve 43 or a servo valve.

In an alternative variant of the invention it is also possible instead of using a cleaning medium to blow the "old" ink out by applying excess pressure to the ventilation openings 26.

For the process of ejecting remaining ink residue or cleaning medium the inkjet printer is designed to have a corresponding collecting device, such as e.g. an ink absorption pad or a suitable collection container.

After this cleaning process has been completed the stop element 6 is set by the control device 24 so that the feed line 5 of the respective tank 3 with the ink of the new ink system is opened so that ink can flow out of the corresponding reservoir 9 into the distribution chamber 11 of the printing head 2. By operating the corresponding pump 14 the ink is simultaneously conveyed out of the corresponding tank 3 into the corresponding reservoir 9. As described above the filling height of the distribution chamber 11 and the reservoir 9 is measured by means of the filling height sensors 25 and the control device 24, and thus kept within a prespecified range.

It should be noted in particular that the individual parts of the inkjet printing apparatus 1 and the printing head 2 in FIG. 1 are not true to scale and are simplified. In particular the volume of the tank 3 or 4 in the actual and practical embodiment of a corresponding inkjet printing apparatus is a multiple of the volume of the distribution chamber 11 of the printing head 2 or the reservoir 9. In addition it should also be noted that the feed lines 5, the return lines 10 and the signal lines or the supply lines between the control device 24 and the stop element 6 or the filling height sensor 25, the heating elements 22 and the thermometers 23 are not rigid connections but are designed as flexible lines or connections. During the printing process the printing head 2 and the reservoirs 9 are moved at times at very high speeds and accelerations over the medium to be printed, so that it is an advantage if the tanks 3 or 4 and the pumps 14 are attached to a part of the inkjet printer which is at rest compared to the printing head 2.

One colour of an ink system can be used by means of such a printing head 2. If the same printing head 2 is a component of an inkjet printing apparatus 1, according to FIG. 1, it is possible to change between two different ink systems, i.e. to the same colour of a different ink system. For a complete inkjet printing apparatus it is of course necessary for each further colour to be used, to have the same arrangement of a printing head 2 and the additional components or elements, as shown in FIG. 1. The tanks 3, the feed lines 5, the reservoirs 9, the return lines 10, the stop elements 6 the pumps 14 and the filters 15 are designed for holding inks from different ink systems as well as different colours. Furthermore, the tank 4 and the corresponding feed line 5, the corresponding pump 14 and the corresponding filter 15 are designed for a cleaning medium in the form of a cleaning liquid, said parts can also be designed for holding compressed air as a cleaning medium.

Figure 2:
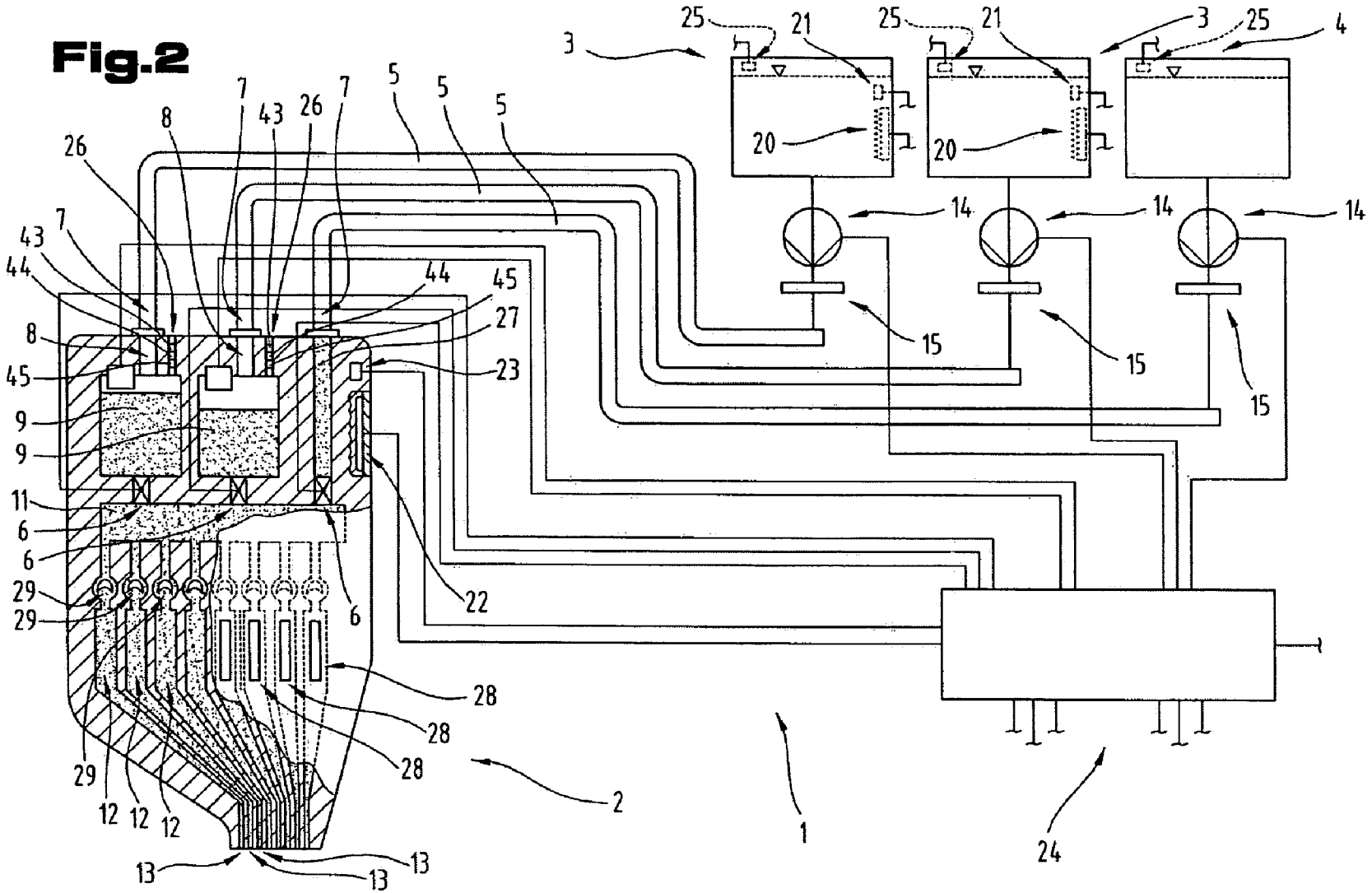
FIG. 2 shows a printing head with several reservoirs for inks or a cleaning medium.

FIG. 2 shows a printing head 2 with two reservoirs 9 and a feed opening 27 for a cleaning medium. The printing head 2 is thus connected via the feed lines 5 to two tanks 3 for inks or a tank 4 for a cleaning medium.

At a first end the two reservoirs 9 of the printing head 2 are connected by a feed opening 8 with the connection opening 7 of a feed line 5. At its second end the reservoirs 9 are connected by stop elements 6 to the distribution chamber 11 or an upper end of the—in this embodiment eight—spray devices 12. The feed opening 27 for the cleaning medium is also connected by a stop element 6 to the upper end of the spray devices 12. At their first ends the reservoirs 9 also have a ventilation opening 26 equipped with an air filter 45. The air filter 45 prevents dust particles entering the printing head 2 and causing a blockage in the nozzles 13.

As already described in the description of the FIG. 1, preferably a pressure control circuit 44 is preferably connected to the ventilation opening 3, by means of which the pressure can be adjusted on the inside of the printing head 2 so that ink cannot escape by mistake through the nozzles 13, i.e. without operating the spray device 12.

A pump 14 and a filter 15 are arranged respectively in the feed lines 5 of the tank 3 for the inks or the tank 4 for the cleaning medium. The inks or the cleaning medium can be conveyed by the pumps 14 into the printing head 2. The filters 15 can prevent impurities coming out of the tanks 3 or 4 into the printing head 2. In order to control the inkjet printing apparatus 1 the latter is equipped with the control device 24. The control of the various operating states of the inkjet printing apparatus 1 can thus be automated or program controlled as well as semi automated, i.e. by the manual input of parameters into a control panel (not shown) of the control device 24 or by the manual adjustment of the various operating states.

In order to control the supply of ink or cleaning medium the control device 24 is connected to the pumps 14, the stop elements 6 and also the filling height sensors 25. In order to keep the inks during their use at the required operating temperature the tanks 3 or the printing head 2 are equipped with the heating elements 20 or 22 and thermometers 21 or 23. In order to regulate the operating temperature of the inks said heating elements 20 or 22 and the thermometer 21 or 23 are also connected to the control device 24.

By opening one of the stop elements 6 of one of the two reservoirs 9 ink can flow out of the reservoir 9 into the spray devices 12, so that in this way the supply of spray devices 12 with a corresponding ink from the corresponding ink system is ensured. The flow of ink from the reservoir 9 into the region of the spray devices 12 is thus ensured in that there can be equalization of pressure through the ventilation openings 26. If by the filling height sensors 25 in cooperation with the control device 24 the filling height in the reservoir 9 is seen to fall, the control device 24 drives the corresponding pump 14 so that a sufficient amount of ink is put into the reservoir 9 from the corresponding tank 3.

In a further embodiment of the printing head according to FIG. 2 it is also possible in an advantageous manner for the stop elements 6 to be in the form of a common multiway valve.

The ejection of ink through the nozzles 13 in the lower end region of the spray devices 12 is performed in a known way by operating the spray devices via corresponding data lines (not shown) or a corresponding control device (not shown) of the inkjet printer.

The spray devices 12 are also equipped with an actuator 28 and a liquid diode 29. The actuator 28 can be in the form of an electro restrictive element which is arranged on an outer wall of an elastically deformable housing wall of the nozzle head 2 in the region of the spray device 12. If on the actuator 28 designed as an electro restrictive element there is electric current a pressure impulse is exerted on the ink located in the region of the spray device, so that the ink is moved on the one hand in the direction of the nozzle 13 and on the other hand in the direction of the liquid diode 29. By means of the liquid diode 29 the movement of ink from the actuator 28 in the direction of the liquid diode 29 is mainly suppressed so that as a result a drop of ink is ejected from the nozzle 13 onto the medium to be printed. Alternatively, it is also possible to design the actuator 28 in the form of a corresponding heating element so that ink is heated so high in the region of the spray device 12 that it forms a bubble of steaming ink, which finally leads to the ejection of a drop of ink from the nozzle 13. The actuator 28 can of course also cause the ejection of ink by a different physical effect, e.g. electrostatically.

If the inkjet printing apparatus needs to be adjusted for working inks of a different ink system firstly the stop elements 6 of the ink reservoir 9 are closed and the locking elements 6 allocated to the feed opening 27 is opened for feeding a cleaning medium. The pump 14 allocated to the tank 4 is then driven by the control device 24 so that the cleaning medium is conveyed into the nozzle 2 and through the spray devices 12 and the nozzles 13. In this way the ink residue from the nozzle 2 remaining in the region of the spray devices 12 and the nozzles 13 is removed and these areas are cleaned. In addition to cleaning with a cleaning medium in the form of a cleaning liquid it is also possible for compressed air to be blown by the pump 14 into the printing head 2 and the spray devices 12 and the nozzles can be cleaned of the remaining residue of cleaning liquid.

As already explained in the description of FIG. 1 the inkjet printer is provided with a collecting device for the described procedure of ejecting remaining ink residue or the cleaning medium, such as e.g. an ink absorption pad or a suitable collecting container.

After the described cleaning process the corresponding stop element for the ink of the new ink system is opened by the control device 24 so that the ink can flow into the spray devices 12 and the nozzles 13. Thus the inkjet printing apparatus is adjusted for working with inks from the new ink system. For inkjet printing apparatus which are to be used with ink systems of more than one colour, it is of course necessary that for each of the colours there is an apparatus with the elements, as shown in FIG. 2. It is of course also possible to have only one common control device 24.

As explained in the description of FIG. 1 it should be stressed that the individual parts are not true to scale and are simplified. Thus the volumes of the tanks 3 or 4 in the actual and practical embodiment of a corresponding inkjet printing apparatus are a multiple of the volume of the reservoir 9 of the printing head 2. Likewise the feed lines 5 and the various connections between the control device 24 and the stop element 6, the pumps 14 and the heating elements 20 or 22 and the thermometers 21 or 23 and the filling height sensors 25 are designed to be flexible.

Figure 3:
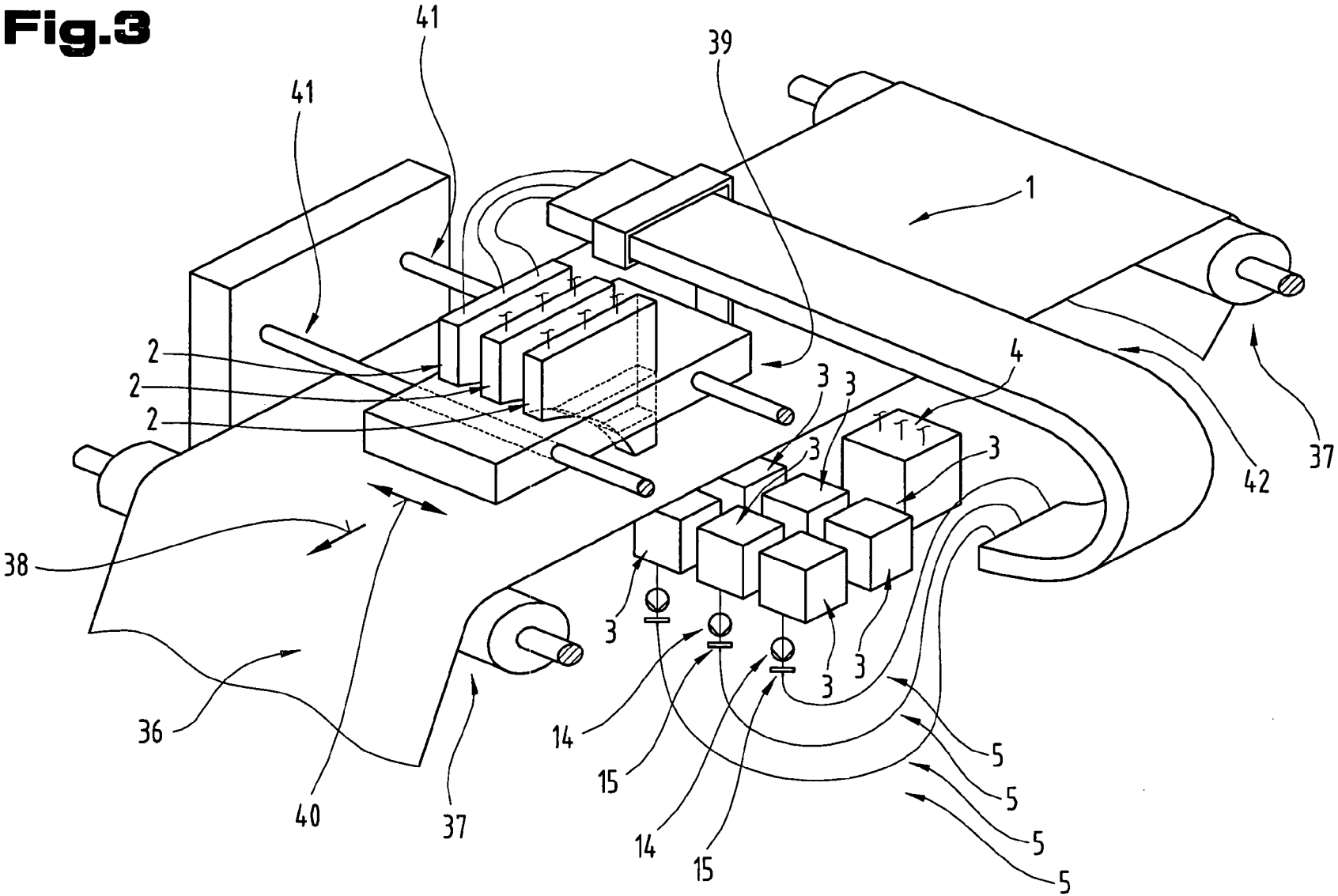
FIG. 3 shows a detail of an inkjet printer with three inkjet printing apparatus according to FIG. 2 in perspective and in simplified view.

FIG. 3 shows a detail of an inkjet printer with three inkjet printing apparatus 1 according to FIG. 2, in a perspective and much simplified view.

A printing medium 36 is moved in one direction 38 by a transport device 37 comprising rollers. Three printing heads 2 are secured in a slide 39 so that the latter can be moved at a small distance over the printing medium 36 in lateral direction i.e. in a direction 40 perpendicular to the direction 38 of the movement of the printing medium 36. In order to move the slide 39 in transverse direction (direction 40) the latter is guided along two transverse guide tracks 41. During this movement of the printing heads 2 over the printing medium 36 the printing medium 36 is printed with the ink ejected from the printing heads 2. The ink is thus conveyed from the corresponding tanks 3 through the pumps 14 and the feed lines 5 into the printing heads 2. The feed lines 5 and the data and control lines (not shown) are in addition, in a known manner guided through a flexible guide channel 42. In this way one end of the guide channel 42 is secured to a fixed part of the frame (not shown) of the inkjet printer, whilst the second end region of the guide channel 42 is secured to the slide 39.

In order to keep the inks in the feed lines 5 at the required operating temperature the latter are connected with a heating element (not shown) and a thermometer (not shown). Of course it is also possible—in particular over the course of the guide channel 42—for the supply lines 5 to be connected to a common heating element and/or a common thermometer.

In the case of high performance modern inkjet printers the movement of the slide 39 with the printing heads 2 is performed partly at high accelerations. The acceleration forces acting on the ink in the printing heads 2 can lead to undesirable pressure fluctuations of the ink in the spray devices 12 or in the nozzles 13 (FIG. 1, FIG. 2). As a result this can cause fluctuations in the volume of the drops of ink ejected through the nozzles 13 or the suction of air or the deposit of ink and thus worsen picture quality. In order to avoid the corresponding pressure fluctuations, as already described in FIGS. 1 and 2, the distribution chamber 11 or the reservoirs 9 are designed to have ventilation openings 26 or pressure control circuits 44 are connected to ventilation openings 26. By means of these ventilation openings 26 it is possible to equalize the pressure with the environmental pressure. In order to avoid differences in pressure between different spray devices 12 of a printing head 2 (a system of communicating vessels) the spray devices 12 or the nozzles 13 are aligned perpendicular to direction 40, i.e. perpendicular to the transverse direction of the slide 39. A third measure for avoiding variations in pressure is finally that the feed lines 5 or the return lines 10 as well as the lines between the stop element 6 and the printing head 2 are made of an elastically restorable deformable material. In particular the said lines are designed to be elastically restorable with a predeterminable force in radial direction.

With the inkjet printing apparatus 1 according to FIG. 1 or FIG. 2 it is possible to manufacture inkjet printers which permit simple conversion for processing inks from different ink systems. By designing inkjet printers with inkjet printing apparatus 1 according to the invention the corresponding inkjet printers can be used universally with very short conversion times. The further elements of such an inkjet printer are on the one hand a transport device for a medium 36 to be printed and on the other hand a transport device or a drive for moving the printing heads 2 over the printing medium 36. A corresponding inkjet printer also has a control device which is connected with the drives for the transport device for the printing medium 36 and the transport device for nozzle heads 2 or the slide 39, and a system of data lines or a data network which can be controlled by the control device of the printing heads 2 in such a way that from the image information data the corresponding image can be applied to the medium 36 to be printed. In the case of inkjet printers with a plurality of printing heads 2 it is of course also possible that several printing heads 2 use the same colour. It is also possible that tanks 3 with several inkjet printing devices 1 for inks of the same ink system and the same colour are formed respectively by common tanks 3.

For form's same it should be pointed out that for a better understanding of the structure of the inkjet printing apparatus or the printing head the latter or their components are not always drawn to scale and/or have been enlarged and/or reduced in size.

The objective forming the basis of the independent solutions of the invention can be taken from the description.

Mainly the individual designs shown in FIGS. 1; 2; 3 can form the subject of independent solutions according to the invention. The objectives and solutions of the invention can be taken from the detailed descriptions of said figures.

| List of Reference Numbers | |
|---|---|
| 1. | Inkjet printing apparatus |
| 2. | Printing head |
| 3. | Tank |
| 4. | Tank |
| 5. | Feed line |
| 6. | Stop element |
| 7. | Connection opening |
| 8. | Feed opening |
| 9. | Reservoir |
| 10. | Return line |
| 11. | Distribution chamber |
| 12. | Spray device |
| 13. | Nozzle |
| 14. | Pump |
| 15. | Filter |
| 16. | Pump |
| 17. | Stop element |
| 18. | Stop element |
| 19. | |
| 20. | Heating element |
| 21. | Thermometer |
| 22. | Heating element |
| 23. | Thermometer |
| 24. | Control device |
| 25. | Filling height sensor |
| 26. | Ventilation opening |
| 27. | Feed opening |
| 28. | Actuator |
| 29. | Liquid diode |
| 36. | Printing medium |
| 37. | Transport device |
| 38. | Direction |
| 39. | Slide |
| 40. | Direction |
| 41. | Transverse guide track |
| 42. | Guide channel |

The invention claimed is:

1. An inkjet printing apparatus comprising:

(a) at least one printing head comprising a distribution chamber;

(b) a connection opening for the at least one printing head;

(c) a plurality of tanks for at least one of inks and a cleaning medium arranged in front of the connection opening;

(d) a plurality of feed lines connecting the tanks with the connection opening;

(e) a first stop element arranged between each tank and the distribution chamber; and (f) a plurality of reservoirs, each reservoir arranged in a respective feed line between the first stop element and an associated tank;

wherein at least one of the reservoir and the printing head comprises at least one of a first heating element and a thermometer.

2. The inkjet printing apparatus according to claim 1, wherein the at least one reservoir is designed as a pressure compensating container.

3. The inkjet printing apparatus according to claim 1, wherein at least one further reservoir is arranged in the printing head.

4. The inkjet printing apparatus according to claim 1, wherein the first stop element is designed as a multiway valve.

5. The inkjet printing apparatus according to claim 1, wherein a first pump is arranged between each tank and the connection opening.

6. The inkjet printing apparatus according to claim 5, wherein a second stop element is arranged in the feed line between each tank and the reservoir connected therewith.

7. The inkjet printing apparatus according to claim 6, wherein a third stop element is arranged in a return line between each tank and the reservoir connected therewith.

8. The inkjet printing apparatus according to claim 7, wherein the tanks, the feed lines, the reservoirs, the first, the second and the third stop elements, the first pump and a second pump and the filters are designed for holding inks of different ink systems.

9. The inkjet printing apparatus according to claim 7, wherein the tanks, the feed lines, the reservoirs, the first, the second and the third stop elements, the first pump and a second pump and the filters are designed for holding a cleaning fluid as a cleaning medium.

10. The inkjet printing apparatus according to claim 7, wherein the reservoir is connected by a return line and a pump to the tank.

11. The inkjet printing apparatus according to claim 7, wherein the tanks, the feed lines, the reservoirs, the first, the second and the third stop elements, the first pump and a second pump and the filters are designed for holding inks of different colors.

12. The inkjet printing apparatus according to claim 7, wherein the tanks, the feed lines, the reservoirs, the first, the second and the third stop elements, the first pump and a second pump and the filters are designed for holding compressed air as a cleaning medium.

13. The inkjet printing apparatus according to claim 1, wherein a filter is arranged between each tank and the connection opening.

14. The inkjet printing apparatus according to claim 1, wherein the tanks are designed to have a common heating element.

15. The inkjet printing apparatus according to claim 1, wherein the feed lines are connected with a heating element.

16. The inkjet printing apparatus according to claim 1, wherein a common heating element is allocated to several feed lines.

17. The inkjet printing apparatus according to claim 1, wherein the printing head is designed to have a heating element.

18. The inkjet printing apparatus according to claim 1, wherein a filling height sensor is arranged in an inner chamber of tanks for the inks.

19. The inkjet printing apparatus according to claim 18, wherein the filling height sensor is arranged in an upper end region of the tanks.

20. The inkjet printing apparatus according to claim 18, wherein the filling height sensor is arranged in an upper end region of the reservoir.

21. The inkjet printing apparatus, according to claim 18, wherein the filling height sensor is arranged in an upper end region of the distribution chamber.

22. The inkjet printing apparatus according to claim 1, wherein the reservoir for the inks is designed to have at least one ventilation opening.

23. The inkjet printing apparatus according to claim 22, wherein a pressure control circuit is connected to the at least one ventilation opening.

24. The inkjet printing apparatus according to claim 22, wherein an air filter is arranged in the at least one ventilation opening.

25. The inkjet printing apparatus according to claim 1, wherein the distribution chamber of the printing head is designed to have at least one ventilation opening.

26. The inkjet printing apparatus according to claim 22, wherein a pressure control valve is arranged in the at least one ventilation opening.

27. The inkjet printing apparatus according to claim 1, wherein the feed line is designed to be elastically restorable.

28. The inkjet printing apparatus according to claim 1, wherein the feed line is designed to be elastically restorable with a prespecifiable force in radial direction.

29. The inkjet printing apparatus according to claim 7, wherein first and second tanks are connected via independent stop elements to several printing heads.

30. The inkjet printing apparatus according to claim 29, wherein the first, the second and the third stop elements, the pumps, the filling height sensors, the heating elements and the thermometers are connected to a control device.

31. The inkjet printing apparatus according to claim 30, wherein the control device is designed for filling the first tank with ink.

32. The inkjet printing apparatus according to claim 30, wherein the control device is designed for filling the second tank with cleaning medium.

33. The inkjet printing apparatus according to claim 1, wherein the control device is designed for controlling the filling of the distribution chamber with ink.

34. The inkjet printing apparatus according to claim 1, wherein the reservoir is designed for applying low pressure.

35. The inkjet printing apparatus according to claim 1, wherein the tanks are designed to have a common thermometer.

36. The inkjet printing apparatus according to claim 1, wherein the feed lines are connected with a thermometer.

37. The inkjet printing apparatus according to claim 1, wherein a common thermometer is allocated to several feed lines.

38. The inkjet printing apparatus according to claim 1, wherein the printing head is designed to have a thermometer.

39. The inkjet printing apparatus according to claim 1, wherein a filling height sensor is arranged in an inner chamber of the reservoir for the inks.

40. The inkjet printing apparatus according to claim 1, wherein a filling height sensor is arranged in an inner chamber of a distribution chamber for the inks.

41. The inkjet printing apparatus according to claim 1, wherein the control device is designed for controlling the filling of the reservoir with ink.

42. A printing head for an inkjet printing apparatus comprising:

(a) at least one spray device;

(b) a distribution chamber for releasing ink into the at least one spray device having a distribution chamber end;

(c) a ventilation opening arranged at the distribution chamber end connecting the distribution chamber to ambient air;

(d) at least one reservoir for inks of various ink systems and various colors and a cleaning medium comprising a cleaning liquid or compressed air, each reservoir having a feed opening at a first end of the reservoir and a stop element between a second end of the reservoir and the distribution chamber; and (e) at least one member selected from the group consisting of a first heating element and a thermometer, said at least one member being thermal-conductively connected to the at least one reservoir.

43. The printing head according to claim 42, wherein the reservoir for the inks is designed to have at least one ventilation opening.

44. The printing head according to claim 43, wherein a pressure control valve is arranged in the ventilation opening.

45. The printing head according to claim 43, wherein a pressure control circuit is connected to the ventilation opening.

46. The printing head according to claim 43, wherein an air filter is arranged in the ventilation opening.

* * * * *